US007392125B2

(12) United States Patent
Ikari

(10) Patent No.: US 7,392,125 B2
(45) Date of Patent: Jun. 24, 2008

(54) WORKING UNIT CONTROL APPARATUS OF EXCAVATING AND LOADING MACHINE

(75) Inventor: Masanori Ikari, Sayama (JP)

(73) Assignee: Komatsu Ltd., Tokyo (JP)

( * ) Notice: Subject to any disclaimer, the term of this patent is extended or adjusted under 35 U.S.C. 154(b) by 32 days.

(21) Appl. No.: 11/353,166

(22) Filed: Feb. 14, 2006

(65) Prior Publication Data

US 2006/0179690 A1 Aug. 17, 2006

Related U.S. Application Data

(62) Division of application No. 09/814,099, filed on Mar. 22, 2001, now Pat. No. 7,076,354.

(30) Foreign Application Priority Data

Mar. 24, 2000 (JP) ..... 2000-085427
Mar. 24, 2000 (JP) ..... 2000-085446
Mar. 24, 2000 (JP) ..... 2000-085448

(51) Int. Cl.
*E02F 5/02* (2006.01)
*G06F 19/00* (2006.01)

(52) U.S. Cl. ..... 701/50; 37/414

(58) Field of Classification Search ..... 701/50
See application file for complete search history.

(56) References Cited

U.S. PATENT DOCUMENTS 4,332,517 A 6/1982 Igarashi et al. ..... 414/699
5,356,259 A 10/1994 Hanamoto et al. ..... 414/694
5,528,843 A 6/1996 Rocke ..... 37/348
5,535,532 A * 7/1996 Fujii et al. ..... 37/348
5,787,787 A 8/1998 Kim et al. ..... 91/361
5,903,988 A 5/1999 Tochizawa et al. ..... 37/348
5,950,430 A 9/1999 Tohji et al. ..... 60/426
5,957,989 A 9/1999 Egawa et al. ..... 701/50
5,999,872 A 12/1999 Kinugawa et al. ..... 701/50
6,280,010 B1 8/2001 Oertley ..... 305/144

FOREIGN PATENT DOCUMENTS

JP 02-038628 2/1990
JP 5-065723 3/1993
JP 6-58345 3/1994
JP 8-68069 3/1996
JP 8-189056 7/1996
JP 9-287165 11/1997
JP 2000-96601 4/2000

* cited by examiner

*Primary Examiner*—Michael J. Zanelli
(74) *Attorney, Agent, or Firm*—Kratz, Quintos & Hanson, LLP

(57) ABSTRACT

The invention provides a working unit control apparatus of an excavating and loading machine which can always judge a start of an excavation control at a proper timing. The working unit control apparatus has excavating state detecting means (43, 44) detecting an excavating state of a vehicle, and a controller (25) has a load judging portion (48) judging on the basis of a detecting amount, and automatic excavation control means (51) setting and outputting an automatic excavation command value to each of control valves on the basis of the judgement of said load judging portion, and an automatic excavation control is started when a boom lever is operated and it is judged that a vehicle is under excavation.

6 Claims, 9 Drawing Sheets

WORKING UNIT CONTROL APPARATUS OF EXCAVATING AND LOADING MACHINE

This application is a Divisional of prior application Ser. No. 09/814,099 filed on Mar. 22, 2001 now U.S. Pat. No. 7,076,354.

FIELD OF THE INVENTION

The present invention relates to a working unit control apparatus of an excavating and loading machine having a vertically movable and rotatable working unit provided in a front portion of a vehicle.

BACKGROUND OF THE INVENTION

As a construction machine performing an excavating and loading operation, there is a wheel loader having a bucket in a front portion of a vehicle and mainly excavating a loaded object such as crushed stones and rocks, earth and sand, or the like by the bucket so as to load on a dump truck or the like. FIG. 10 shows a side elevation view of the wheel loader.

In FIG. 10, a wheel loader 1 is provided with a working unit 5 having a boom 3 attached to a front portion of a travelable vehicle body 2 in such a maimer as to freely move in a vertical direction, and a bucket 4 pivoted to a front end portion of boom 3 in such a manner as to freely rotate in a vertical direction. The boom 3 and the bucket 4 are operated by operating levers (not shown) provided within an operating room 7 mounted on the vehicle body 2. At a time of excavating a loaded object 6 so as to load on the bucket, the boom operation and the bucket operation are alternately performed while forward moving the vehicle toward a heap of the loaded object 6. In this case, rotating the bucket 4 around a pin 8 in a clockwise direction in FIG. 10 is called a tilting operation.

A technique of semi-automatically controlling a bucket angle of the bucket 4 in correspondence to a change of a boom angle of the boom 3 so as to improve an operating efficiency, in the excavating operation mentioned above is shown in Japanese Unexamined Patent Publication No. 2000-96601. In accordance with this publication, a relation of the bucket angle with respect to the boom angle at a time of excavating is previously stored, and the bucket angle with respect to the boom angle operated by an operator is controlled so as to satisfy the relation mentioned above after a control start signal is input from the operator. That is, the bucket angle is controlled so that a detecting amount of a bucket angle detector becomes a stored target bucket angle.

However, in accordance with the prior art mentioned above, the operator determines the control start. A skilled operator can properly judge the control start timing so as to improve an efficiency of the excavating operation, however, it is hard for an operation having a low skill level to properly judge the excavation start timing. Accordingly, there is a case that the operating efficiency can not be improved because the control start timing is not properly judged, further, there is a case that the operating efficiency is reduced in some controls.

Further, in accordance with the conventional art, when the boom angle becomes a predetermined angle, the bucket is tilted by extending a bucket cylinder controlling the bucket angle for a predetermined time. However, in this control method, there is a case that the bucket angle corresponding to the boom angle can not be obtained due to a relief of a hydraulic circuit in the bucket cylinder or the like. In this case, since the bucket cylinder does not extend to a stroke end when the boom angle reaches a predetermined angle and the excavating control is finished, the tilt of the bucket is insufficient and a load scattering is generated. Further, since the bucket cylinder extends to the stroke end before the excavation control is finished, the hydraulic circuit of the bucket cylinder is wastefully relieved. Accordingly, it is impossible to control the working unit in accordance with an intention of the operator and the operating efficiency can not be improved.

DISCLOSURE OF THE INVENTION

The present invention is made by taking the problems mentioned above into consideration, and an object of the present invention is to provide a working unit control apparatus of an excavating and loading machine which can always judge a start of an excavation control at a proper timing and control in accordance with an intention of an operator during a control of the working unit.

In accordance with a first aspect of the present invention, there is provided a working unit control apparatus of an excavating and loading machine comprising:

a boom cylinder controlling a lift of a boom;

a boom control valve controlling extension and compression of the boom cylinder;

a boom lever instructing an extension and compression speed of the boom cylinder;

a boom lever operating amount detector detecting an operating amount of the boom lever;

a bucket cylinder controlling a tilt of the bucket;

a bucket control valve controlling an extension and compression of the bucket cylinder;

a bucket lever instructing an extension and compression speed of the bucket cylinder;

a bucket lever operating amount detector detecting an operating amount of the bucket lever; and a controller outputting a boom control command value to the boom control valve on the basis of the boom lever operating amount input from the boom lever operating amount detector, and outputting a bucket control command value to the bucket control valve on the basis of the bucket lever operating amount input from the bucket lever operating amount detector, wherein the working unit control apparatus has excavating state detecting means detecting an excavating state of a vehicle, the controller has a load judging portion judging on the basis of a detecting amount input from the excavating state detecting means whether or not the vehicle is under excavation, and automatic excavation control means setting and outputting an automatic excavation command value to each of the control valves on the basis of the judgement of the load judging portion, and the automatic excavation control means judges an automatic excavation start when the boom lever is operated and the load judging portion judges that the vehicle is under excavation.

In accordance with the first aspect of the present invention, when the load judging portion judges that the load applied to the vehicle from the bucket is equal to or more than the predetermined value and the operator operates the boom lever, the automatic excavation is started. That is, since the operating pattern of "operating the boom lever so as to ascend the bucket" performed by the skilled operator at a time of starting excavating is installed in the control flow and the excavation start is judged when the operation mentioned above is performed, it is possible to always securely judge a timing of the excavation start.

In accordance with a second aspect of the present invention, there is provided a working unit control apparatus of an excavating and loading machine as recited in the first aspect, wherein the excavating state detecting means is constituted by a vehicle speed detector detecting a vehicle speed and an engine rotational speed detector detecting an engine rotational speed, and the load judging portion is structured such as to judge that the vehicle is under excavation when the vehicle speed is equal to or less than a value shown by a predetermined curve relating to the engine rotational speed.

In accordance with the second aspect, it is judged that the vehicle speed is not increased due to a great load applied to the vehicle, that is, the excavating operation is performed, when the vehicle speed is equal to or less than the value shown by the predetermined curve corresponding to the engine rotational speed. Since the predetermined curve corresponds to a curve obtained by collecting and setting the vehicle speed data during the excavation at a time of excavation by the skilled operator, it is possible to securely judge the excavating operation is performed.

In accordance with a third aspect of the present invention, there is provided a working unit control apparatus of an excavating and loading machine as recited in the first aspect, wherein the excavating state detecting means is constituted by an accelerator pedal operating amount detector detecting an accelerator pedal operating amount and an engine rotational speed detector detecting an engine rotational speed, and the load judging portion is structured such as to judge that the vehicle is under excavation when the accelerator pedal operating amount is equal to or more than a predetermined operating amount and the engine rotational speed is equal to or less than a predetermined rotational speed.

In accordance with the third aspect, it is judged that the load applied to the vehicle is great in spite of pedaling the accelerator pedal and the engine rotational speed does not become great, that is, the vehicle is under excavation, when the accelerator pedal operating amount is equal to or more than the predetermined amount and the engine rotational speed is equal to or less than the predetermined rotational speed. Since the predetermined operating amount and the predetermined rotational speed correspond to values obtained by collecting and setting the accelerator pedal operating amount data and the engine rotational speed data during the excavation performed by the skilled operator, it is possible to securely judge that the excavating operation is performed.

In accordance with a fourth aspect of the present invention, there is provided a working unit control apparatus of an excavating and loading machine comprising:

a boom cylinder controlling a lift of a boom;

a boom control valve controlling extension and compression of the boom cylinder;

a boom lever instructing an extension and compression speed of the boom cylinder;

a boom lever operating amount detector detecting an operating amount of the boom lever;

a bucket cylinder controlling a tilt of the bucket;

a bucket control valve controlling an extension and compression of the bucket cylinder;

a bucket lever instructing an extension and compression speed of the bucket cylinder;

a bucket lever operating amount detector detecting an operating amount of the bucket lever; and a controller outputting a boom control command value to the boom control valve on the basis of the boom lever operating amount input from the boom lever operating amount detector, and outputting a bucket control command value to the bucket control valve on the basis of the bucket lever operating amount input from the bucket lever operating amount detector, wherein the working unit control apparatus is additionally provided with an engine rotational speed detector detecting an engine rotational speed, the controller has automatic excavation control means setting and outputting an automatic excavation command value to each of the control valves on the basis of any one of a manual command and a judgement of a load judging portion judging whether or not the vehicle is under excavation, and the automatic excavation control means outputs a boom control command value which becomes smaller as the engine rotational speed becomes larger at a time of operating the boom to the boom control valve.

In accordance with the forth aspect of the present invention, when the boom lever is operated, the boom lever operating amount is not directly output to the boom control valve but the boom control command value on the basis of the engine rotational speed is output. It is judged that the load applied to the vehicle is increased when the engine rotational speed becomes small, so that the bucket is early lifted so as to reduce the load. It is judged that the load is small when the engine rotational speed becomes large, so that the lifting speed of the bucket is restricted so as to prevent the load from being released. Accordingly, since the load can be always properly kept, an excavating efficiency can be improved.

In accordance with a fifth aspect of the present invention, there is provided a working unit control apparatus of an excavating and loading machine comprising:

a boom cylinder controlling a lift of a boom;

a boom control valve controlling extension and compression of the boom cylinder;

a boom lever instructing an extension and compression speed of the boom cylinder;

a boom lever operating amount detector detecting an operating amount of the boom lever;

a bucket cylinder controlling a tilt of the bucket;

a bucket control valve controlling an extension and compression of the bucket cylinder;

a bucket lever instructing an extension and compression speed of the bucket cylinder;

a bucket lever operating amount detector detecting an operating amount of the bucket lever; and a controller outputting a boom control command value to the boom control valve on the basis of the boom lever operating amount input from the boom lever operating amount detector, and outputting a bucket control command value to the bucket control valve on the basis of the bucket lever operating amount input from the bucket lever operating amount detector, wherein the working unit control apparatus is additionally provided with an engine rotational speed detector detecting an engine rotational speed, the controller has automatic excavation control means setting and outputting an automatic excavation command value to each of the control valves on the basis of any one of a manual command and a judgement of a load judging portion judging whether or not the vehicle is under excavation, and the automatic excavation control means outputs a control command value which is based on any one of the engine rotational speed and the boom lever operating amount to the bucket control valve.

In accordance with the fifth aspect of the present invention, at a time of controlling the excavating operation, the command value to the bucket control valve is set and output on the basis of any one of the engine rotational speed and the boom lever operating amount. A magnitude of the load applied to the vehicle body and the boom lever operating state of the operator are always reflected to the operation of the bucket. Accordingly, since it is possible to properly keep the load, an excavating efficiency can be improved.

In accordance with a sixth aspect of the present invention, there is provided a working unit control apparatus of an excavating and loading machine as recited in the fifth aspect, wherein the automatic excavation control means is structured such as to output a bucket control command value corresponding to the boom lever operating amount to the bucket control valve at a time of operating the boom lever.

In accordance with the sixth aspect, since the bucket is early lifted so as to reduce the load when the operator largely operates the boom lever, the bucket control command value is accordingly set to be large in corresponding to the boom lever operating amount. Therefore, since it is possible to obtain a lift and tilt speed with a good balance in accordance with an intention of the operator, an excavating efficiency can be improved.

In accordance with a seventh aspect of the present invention, there is provided a working unit control apparatus of an excavating and loading machine as recited in the fifth aspect, wherein the automatic excavation control means is structured such as to output a bucket control command value which becomes smaller as the engine rotational speed becomes larger to the bucket control valve.

In accordance with the seventh aspect, when the engine rotational speed becomes small, it is judged that the load applied to the vehicle becomes large so as to early tilt the bucket and reduce the load, and when the engine rotational speed becomes large, it is judged that the load is small so as to restrict the tilting speed of the bucket and prevent the load from being released. Accordingly, since the load can be always kept proper, an excavating efficiency can be improved.

In accordance with an eighth aspect of the present invention, there is provided a working unit control apparatus of an excavating and loading machine comprising:

a boom cylinder controlling a lift of a boom;

a boom control valve controlling extension and compression of the boom cylinder;

a boom lever instructing an extension and compression speed of the boom cylinder;

a boom lever operating amount detector detecting an operating amount of the boom lever;

a bucket cylinder controlling a tilt of the bucket;

a bucket control valve controlling an extension and compression of the bucket cylinder;

a bucket lever instructing an extension and compression speed of the bucket cylinder;

a bucket lever operating amount detector detecting an operating amount of the bucket lever; and a controller outputting a boom control command value to the boom control valve on the basis of the boom lever operating amount input from the boom lever operating amount detector, and outputting a bucket control command value to the bucket control valve on the basis of the bucket lever operating amount input from the bucket lever operating amount detector, wherein the controller has automatic excavation control means setting and outputting an automatic excavation command value to each of the control valves on the basis of any one of a manual command and a judgement of a load judging portion judging whether or not the vehicle is under excavation, and the automatic excavation control means outputs a bucket control command value to the bucket control valve without relation to an operation or a stop of the boom cylinder.

In accordance with the eighth aspect of the present invention, since it is possible to output the bucket control command value so as to tilt the bucket, thereby properly keeping the load applied to the vehicle even when a circuit of the boom control valve is relieved and the boom cylinder is not extended, an excavating efficiency can be improved.

In accordance with a ninth aspect of the present invention, there is provided a working unit control apparatus of an excavating and loading machine comprising:

a boom cylinder controlling a lift of a boom;

a boom control valve controlling extension and compression of the boom cylinder;

a boom lever instructing an extension and compression speed of the boom cylinder;

a boom lever operating amount detector detecting an operating amount of the boom lever;

a bucket cylinder controlling a tilt of the bucket;

a bucket control valve controlling an extension and compression of the bucket cylinder;

a bucket lever instructing an extension and compression speed of the bucket cylinder;

a bucket lever operating amount detector detecting an operating amount of the bucket lever; and a controller outputting a boom control command value to the boom control valve on the basis of the boom lever operating amount input from the boom lever operating amount detector, and outputting a bucket control command value to the bucket control valve on the basis of the bucket lever operating amount input from the bucket lever operating amount detector, wherein the working unit control apparatus is additionally provided with a mode selecting button setting a mode for outputting the bucket control command value in a continuous manner or a pulse manner, a mode selecting signal output from the mode selecting button is input to the controller, the controller has automatic excavation control means setting and outputting an automatic excavation command value to each of the control valves on the basis of any one of a manual command and a judgement of a load judging portion judging whether or not the vehicle is under excavation, and the automatic excavation control means is structured such as to switch the output mode on the basis of the mode selecting signal.

In accordance with the ninth aspect of the present invention, when the loaded object to be excavated is hard and an excavation resisting force is large, the bucket control command value is output to the pulse manner so as to tilt the bucket in a vibration manner, thereby obtaining a large loading speed of the loaded object to the bucket. On the contrary, when the loaded object is soft and the excavation resisting force is small, the bucket control command value is continuously output so as to early tilt. Accordingly, it is possible to perform an automatic excavation control in accordance with an intention of the operator. Further, since it is possible to always properly keep the load applied to the vehicle, an excavating efficiency can be improved.

In accordance with a tenth aspect of the present invention, there is provided a working unit control apparatus of an excavating and loading machine as recited in the fourth, fifth, eighth or ninth aspect, further comprising a stroke end detector outputting an on signal as a stroke end signal when the bucket cylinder is at a stroke end so as to input the stroke end signal to the controller, wherein the automatic excavation control means is structured such as to complete the automatic excavation control when the stroke end signal is the on signal.

In accordance with the tenth aspect, the structure is made such that the automatic excavation control is completed when the stroke end detector detects the stroke end of the bucket cylinder. Accordingly, since it is possible to sufficiently make full use of the stroke of the bucket cylinder, and it is possible to perform the automatic excavation control in accordance with an intention of the operator, an excavating efficiency can be improved.

In accordance with an eleventh aspect of the present invention, there is provided a working unit control apparatus of an excavating and loading machine comprising:

a boom cylinder controlling a lift of a boom;

a boom control valve controlling extension and compression of the boom cylinder;

a boom lever instructing an extension and compression speed of the boom cylinder;

a boom lever operating amount detector detecting an operating amount of the boom lever;

a bucket cylinder controlling a tilt of the bucket;

a bucket control valve controlling an extension and compression of the bucket cylinder;

a bucket lever instructing an extension and compression speed of the bucket cylinder;

a bucket lever operating amount detector detecting an operating amount of the bucket lever; and a controller outputting a boom control command value to the boom control valve on the basis of the boom lever operating amount input from the boom lever operating amount detector, and outputting a bucket control command value to the bucket control valve on the basis of the bucket lever operating amount input from the bucket lever operating amount detector, wherein the working unit control apparatus has excavating state detecting means detecting an excavating state of a vehicle, the controller has a load judging portion judging on the basis of a detecting amount input from the excavating state detecting means whether or not the vehicle is under excavation, an operating amount change judging portion judging that the boom lever operating amount changed at a zero value from a predetermined operating amount, and automatic excavation control means setting and outputting an automatic excavation command value to each of the control valves on the basis of the judgement of the load judging portion and the operating amount change judging portion, and the automatic excavation control means outputs the automatic excavation command value to each of the control valves when the load judging portion judges that the vehicle is under excavation and the operating amount change judging portion judges that the boom lever operating amount changes from a predetermined operating amount to a zero value.

In accordance with the eleventh aspect of the present invention, when the load judging portion of the controller judges that the load applied to the vehicle from the bucket is equal to or more than the predetermined value and the operating amount change judging portion judges that the operator operates the boom lever and thereafter returns the boom lever to a neutral position, the automatic excavation is started. That is, since it is judged that the excavation is started when the operating of "operating the boom lever and thereafter returning to a neutral position" performed by the skilled operator at a time of starting excavating is performed, it is possible to further securely judge a timing of the excavation start.

In accordance with a twelfth aspect of the present invention, there is provided a working unit control apparatus of an excavating and loading machine as recited in the eleventh aspect, wherein the excavating state detecting means is constituted by a vehicle speed detector detecting a vehicle speed and an engine rotational speed detector detecting an engine rotational speed, and the load judging portion is structured such as to judge that the vehicle is under excavation when the vehicle speed is equal to or less than a value shown by a predetermined curve relating to the engine rotational speed.

In accordance with the twelfth aspect, it is judged that the vehicle speed is not increased due to a great load applied to the vehicle, that is, the excavating operation is performed, when the vehicle speed is equal to or less than the value shown by the predetermined curve corresponding to the engine rotational speed. Since the predetermined curve corresponds to a curve obtained by collecting and setting the vehicle speed data during the excavation at a time of excavation by the skilled operator, it is possible to securely judge the excavating operation is performed.

In accordance with a thirteenth aspect of the present invention, there is provided a working unit control apparatus of an excavating and loading machine as recited in the eleventh aspect, wherein the excavating state detecting means is constituted by an accelerator pedal operating amount detector detecting an accelerator pedal operating amount and an engine rotational speed detector detecting an engine rotational speed, and the load judging portion is structured such as to judge that the vehicle is under excavation when the accelerator pedal operating amount is equal to or more than a predetermined operating amount and the engine rotational speed is equal to or less than a predetermined rotational speed.

In accordance with the thirteenth aspect, it is judged that the load applied to the vehicle is great in spite of pedaling the accelerator pedal and the engine rotational speed does not become great, that is, the vehicle is under excavation, when the accelerator pedal operating amount is equal to or more than the predetermined amount and the engine rotational speed is equal to or less than the predetermined rotational speed. Since the predetermined operating amount and the predetermined rotational speed correspond to values obtained by collecting and setting the accelerator pedal operating amount data and the engine rotational speed data during the excavation performed by the skilled operator, it is possible to securely judge that the excavating operation is performed.

DETAILED DESCRIPTION OF THE PREFERRED EMBODIMENTS

A description will be in detail given below of embodiments in accordance with the present invention with reference to the accompanying drawings.

At first, a description will be given of a first embodiment with reference to FIGS. 1, 2 and 3.

Figure 1:
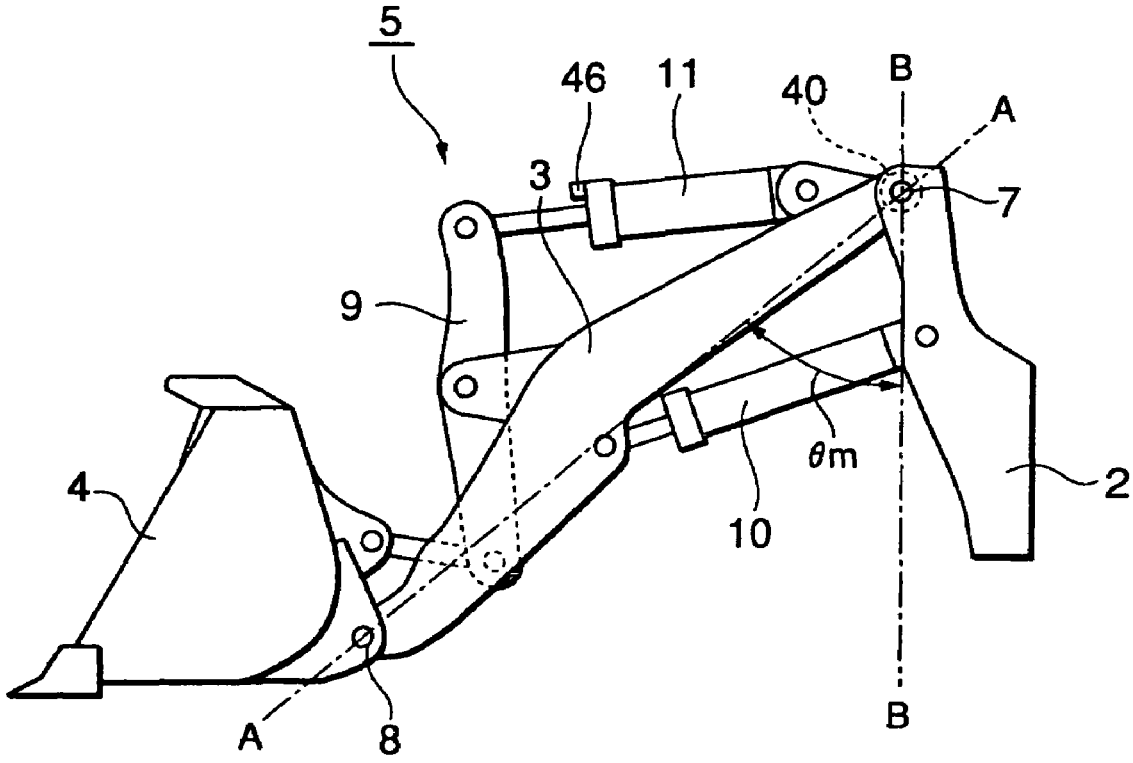
FIG. 1 is a side elevational view of a working unit of a wheel loader in accordance with a first embodiment of the present invention.

FIG. 1 shows a side elevational view of a working unit 5 of a wheel loader 1. A base end portion of a boom 3 is rotatably attached to a vehicle body 2 by a pin 7, and the vehicle body 2 and the boom 3 are connected to a boom cylinder 10. When the boom cylinder 10 is extended, the boom 3 is rotated around the pin 7 so as to be ascended, and when the boom cylinder 10 is compressed, the boom 3 is descended. Further, a bucket 4 is rotatably attached to a front end portion of the boom 3 by a pin 8, and the bucket 4 and the boom 3 are connected via a link 9 by a bucket cylinder 11. When the bucket cylinder 11 is extended, the bucket 4 is titled, and when the bucket cylinder 11 is compressed, the bucket 4 is dumped.

In the working unit 5, a boom angle θm can be expressed by an angle θm formed by a line A-A connecting the pin 7 and the pin 8 and a vertical line B-B passing through the line 7. A boom angle detector 40 detecting the boom angle θm is attached to the pin 7 portion of the base end portion of the boom 3. The boom angle θm is detected by setting the vertical line B-B to zero degree and setting a clockwise direction in FIG. 1 around the pin 7 to a positive angle. Further, a stroke end detector 46 detecting a stroke end of the bucket cylinder 11 is attached to the bucket cylinder 11.

Figure 2:
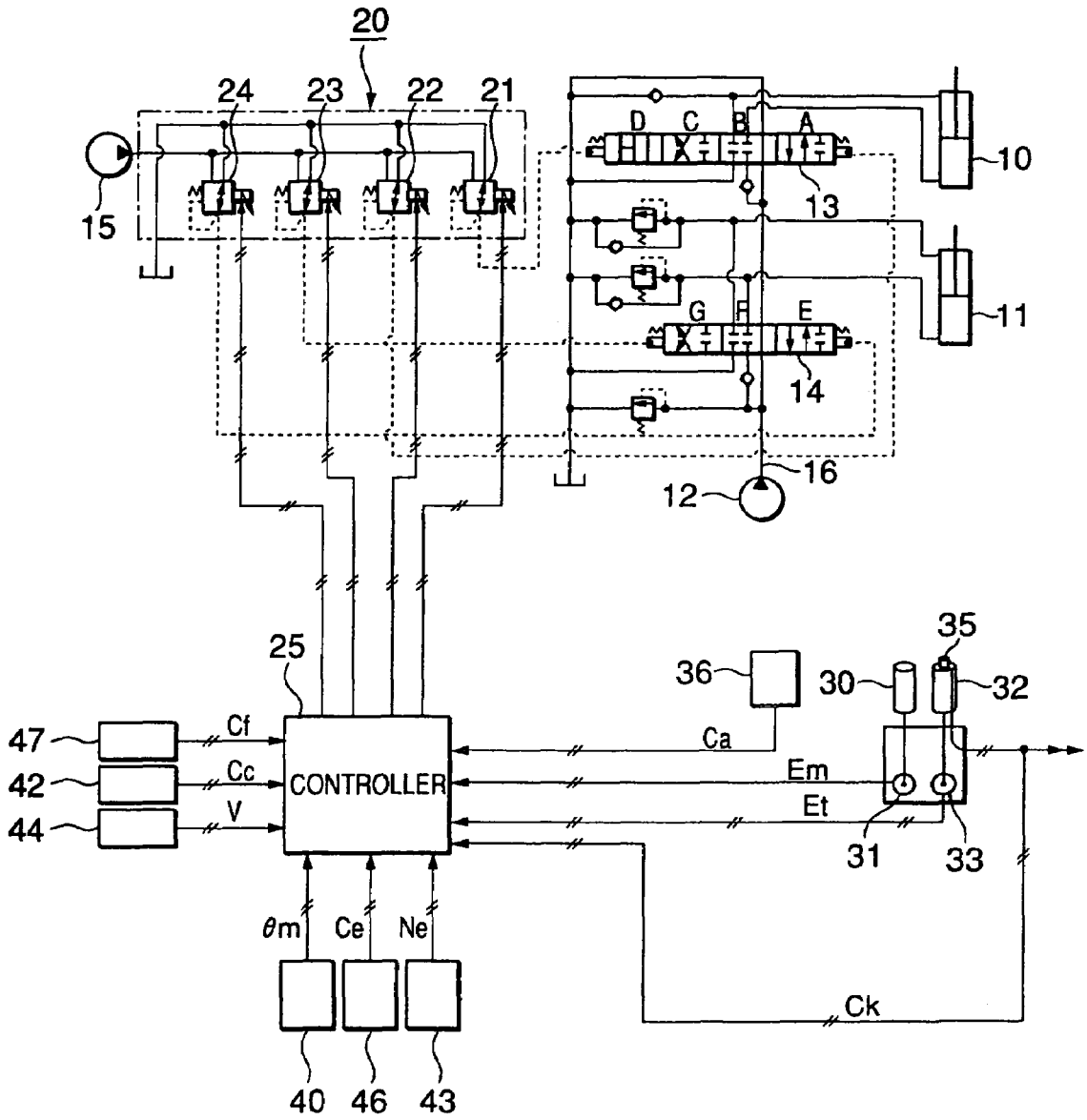
FIG. 2 is a control system diagram of the working unit of the wheel loader in accordance with the first embodiment.

FIG. 2 shows a control system view of an automatic excavation control apparatus in accordance with the present embodiment.

A hydraulic pilot type boom control valve 13 and a bucket control valve 14 which are interposed on a discharge circuit 16 of a working unit hydraulic pump 12 are respectively connected to the boom cylinder 10 and the bucket cylinder 11, thereby constituting a tandem circuit.

The boom control valve 13 is a four position switching valve having an A (boom ascending) position, a B (neutral) position, a C (boom descending) position and a D (floating) position, and the bucket control valve 14 is a three position switching valve having an E (tilt) position, an F (neutral) position and a G (dump) position.

Pilot pressure receiving portions of the boom control valve 13 and the bucket control valve 14 are respectively connected to a pilot pump 15 via an electromagnetic proportional command valve 20. The electromagnetic proportional command valve 20 is constituted by a boom descending command valve 21, a boom ascending command valve 22, a bucket dump command valve 23 and a bucket tilt command valve 24.

The boom descending command valve 21 and the boom ascending command valve 22 are connected to the respective pilot pressure receiving portions of the boom control valve 13, and the bucket damp command valve 23 and the bucket tilt command valve 24 are connected to the respective pressure receiving portions of the bucket control valve 14. Further, respective command signals are input from a controller 25 to solenoid command portions of the respective command valves 21, 22, 23 and 24.

A boom lever operating amount detector 31 detecting a boom lever operating amount Em is attached to a boom lever 30. Further, a bucket lever operating amount detector 33 detecting a bucket lever operating amount Et is attached to a bucket lever 32. Detecting signals of the respective detectors 31 and 33 are input to the controller 25.

A boom angle θm, an engine rotational speed Ne and a vehicle speed V are respectively input from a boom angle detector 40, an engine rotational speed detector 43 and a vehicle speed detector 44 to the controller 25. In this case, the engine rotational speed detector 43 and the vehicle speed detector 44 correspond to means for detecting an excavating state of the vehicle.

An automatic tilt setting switch 36 by which an operator sets whether or not an automatic excavation control should be performed is provided in an operation panel (not shown) in a side portion of an operating room. An automatic tilt signal Ca output from the automatic tilt setting switch 36 is input to the controller 25. In this case, the automatic tilt signal Ca outputs an on signal "1" when the operator performs an on-operation, and outputs an off signal "0" when the operator does not perform the on-operation.

A kick-down switch 35 capable of changing speed from a forward second speed to a forward first speed without operating a shift lever (not shown) is provided in the bucket lever 32. When the operator performs the on-operation, a kick-down signal Ck outputs an on signal "1" to the controller 25 and applies a command to a shift control apparatus (not shown) so as to change the speed to the forward first speed. In this case, when the on-operation is not performed, the kick-down signal Ck outputs an off signal "0".

A stroke end signal Ce is input to the controller 25 from a stroke end detector 46. A stroke of the bucket cylinder 11 reaches a predetermined distance (for example, 5 mm) to a stroke end, the stroke end signal Ce outputs an on signal "1" and outputs an off signal "0" when the bucket cylinder 11 does not reach the predetermined distance.

Further, a forward and backward movement detector 47 is attached near a forward and backward movement lever (not shown) to which the operator applied a forward and backward movement command, and a forward movement signal Cf is input to the controller 25 from the forward and backward movement detector 47. The forward movement signal Cf outputs an on signal "1" at a time of moving forward and outputs an off signal "0" at a time of neutral and moving backward.

Further, a mode selecting button 42 by which the operator selects and operates an optimum excavation mode on the basis of the nature of the soil, an operating condition or the like is arranged in the operation panel (not shown) in the side portion of the operating room. The operator outputs a selecting signal Cc comprising an off signal "0" when the loaded object 6 is soft and has a small excavation resistance and a selecting signal Cc comprising an on signal "1" when the loaded object 6 is hard and has a large excavation resistance, from the mode selecting button 42. The selecting signal Cc is input to the controller 25.

Next, a description will be given of an operation in the case of performing a normal operation without turning on the automatic tilt setting switch 36 with reference to FIG. 2.

When the operator operates the boom lever 30 or the bucket lever 32, a boom lever operating amount Em and a bucket lever operating amount Et are input to the controller 25 from the boom lever operating amount detector 31 and the bucket lever operating amount detector 33. The controller 25 outputs a working unit speed control command corresponding to the operating amount signal to each of the command valves 21, 22, 23 and 24.

The respective command valves 21, 22, 23 and 24 output pilot oil pressures having pressures corresponding to a magnitude of the working unit speed control command to the pilot pressure receiving portion of the corresponding boom control valve 13 or bucket control valve 14. Accordingly, the boom cylinder 10 or the bucket cylinder 11 is operated in a corresponding direction at a speed corresponding to the respective pilot oil pressures.

Next, a description will be given of an operation of the automatic excavation control apparatus in accordance with the present embodiment with reference to control flow charts shown in FIGS. 3 and 5 and an excavating area explaining view shown in FIG. 4. A step number of each of processes in the control flow charts is denoted by attaching a symbol S, and steps S1 to S6 and steps S7 to S15 are respectively shown in FIG. 3 and FIG. 5.

In the step S1, if the following five items are all satisfied, the step goes to a process in the step S2.

(1) An automatic tilt signal Ca is an on signal "1".

(2) A forward movement signal Cf is an on signal "1".

(3) A boom angle θm is smaller than a predetermined boom angle lower limit value θm1.

(4) A kick-down signal Ck is an on signal "1".

(5) A boom lever operating amount Em is larger than a predetermined boom lever operating amount lower limit value Em1.

When any one of five items is not satisfied, the process in the step S1 is repeated.

In this case, the boom lever operating amount Em is equal to or less than the boom lever operating amount lower limit value Em1, a command value to the control valve is a zero value. When the boom lever operating amount Em is larger than the boom lever operating amount lower limit value Em1 and smaller than a predetermined boom lever operating amount upper limit value Em2, the control command values to the boom operating valves 21 and 22 becomes great in correspondence to the operating amount. When the boom lever operating amount Em is equal to or more than the boom lever operating amount upper limit value Em2, the control command value to the boom command valves 21 and 22 keeps the control command value at a time of the boom lever operating amount upper limit value Em2.

In the step S2, it is judged whether or not a vehicle speed V is smaller than the product between a predetermined engine coefficient k and an engine rotational speed Ne. The engine coefficient k is an incline of a straight line distinguishing a state that an excavation is performed when the vehicle speed V is smaller than the product from a state that the excavation is not performed when the vehicle speed V is equal to or more than the product. In this case, the engine coefficient k corresponds to a value set by collecting the vehicle speed data during the excavation at a time of the excavation performed by the skilled operator.

When the vehicle speed V is smaller than the product, the step goes to a process in the step S3, and when the vehicle speed V is equal to or more than the product, the process in the step S2 is repeated. In this case, the process portion in the step S2 is called as a load first judging portion 48.

In the step S3, it is judged whether or not the boom lever operating amount Em is larger than the boom lever operating amount upper limit value Em2. When the amount is larger, the step goes to a process in the step S4, and when the amount is equal to or less than the boom lever operating amount upper limit value Em2, the step goes to a process in the step S7.

In the step S4, it is judged whether or not a boom angular speed θmd is the zero value, and when the boom angular speed is the zero value, the step goes to a process in the step S7, and when it is not the zero value, the step goes to a process in the step S6.

In the step S6, a boom control command signal Vm having a value of the boom lever operating amount Em and a bucket control command value Vt having a value of the bucket lever operating amount Et are respectively output to the electromagnetic proportional command valve 20, and the step goes back to the process in the step S2.

In the step S7, it is judged whether or not the boom lever operating amount Em is smaller than the boom lever operating amount lower limit value Em1. When the boom lever operating amount Em is smaller than the boom lever operating amount lower limit value Em1, the step goes to a process in a step S8. When the boom lever operating amount Em is equal to or more than the boom lever operating amount lower limit Em1, the step goes to a process in the step S10. In this case, the steps S7 to S15 are called as automatic excavation control means 51.

In the step S8, the boom control command value Vm of 0 value is output to the electromagnetic proportional command valve 20 and the step goes to a process in the step S9.

In the step S9, the product between a value obtained by dividing an engine high idle rotational speed Nem by the engine rotational speed Ne, and a predetermined bucket flow amount coefficient αt is set to a bucket flow amount additional value Qt. Since the bucket flow amount coefficient αt is a value expressed by %, the bucket flow amount additional value Qt is also a value expressed by %. Further, a value obtained by adding the bucket flow amount additional value Qt to the bucket lever operating amount Et is set to a bucket control command value Vt, and the step goes to a process in the step S12.

On the contrary, in the step S10, the product between a value obtained by dividing the engine high idle rotational speed Nem by the engine rotational speed Ne and a predetermined boom flow amount coefficient αm is set to a boom flow amount changing value Qm. Since the boom flow amount coefficient αm becomes a value expressed by %, the boom flow amount changing value Qm becomes also a value expressed by %. Then, the bucket control command value Vt having the boom flow amount changing value Qm is output to the electromagnetic proportional command valve 20 and the step goes to a process in the step S11.

In the step 11, a bucket flow amount variable αtv changing in accordance with the boom lever operating amount Em is calculated. Next, the product between a value obtained by dividing the engine high idle rotational speed Nem by the engine rotational speed Ne and the calculated bucket flow amount variable αtv is set to a bucket flow amount additional value Qt. Then, a value obtained by adding the bucket flow amount additional value Qt to the bucket lever operating amount Et is set to a bucket control command value Vt, and the step goes to a process in the step S12.

In the step S12, it is judged whether or not the mode selecting signal Cc is the off signal "0". If the mode selecting signal Cc is the off signal "0", the step goes to a process in the step S13. If the mode selecting signal Cc is not the off signal "0", the step goes to a process in the step S14.

In the step S13, the bucket control command value Vt set in the steps S9 or the step S11 is output to the electromagnetic proportional command valve 20 only for a predetermined time T1 (for example, five seconds), and the step goes to a process in the step S15.

On the contrary, in the step S14, a pulse having the bucket control command value Vt set in the step S9 or the step S11 and a predetermined tilt on time ΔT is output to the electromagnetic proportional command valve 20 only two times at a tilt cycle T2, and the step goes to a process in the step S15.

In the step S15, if any one of the following four items is satisfied, the automatic excavation control is completed.

(1) A forward movement signal Cf is an off signal "0".

(2) A stroke end signal Ce is an on signal "1".

(3) A boom angle θm is larger than a predetermined boom angle upper limit value θm2.

(4) A tilt number Nt is larger than a predetermined tilt number threshold Ntm.

When none of four items is satisfied, the step goes back to the process in the step S7. In this case, the tilt number Nt is set to a number at which the process in the step S7 is executed, Here, a description will be given of an operating pattern at a time of starting the excavation performed by the skilled operator.

When the tip end of the bucket 4 in the vehicle is eaten into the loaded object 6 by the operator, a horizontal resisting force applied to the vehicle body from the tip end becomes large and the vehicle speed V is reduced. When the vehicle speed V is in an excavating area shown by a hatched portion in FIG. 4, the skilled operator at first operates the boom lever 30 so as to ascend the boom 3, thereby intending to reduce the horizontal resisting force, generally.

Next, a description will be given of an operation and an effect of the present embodiment.

Figure 4:
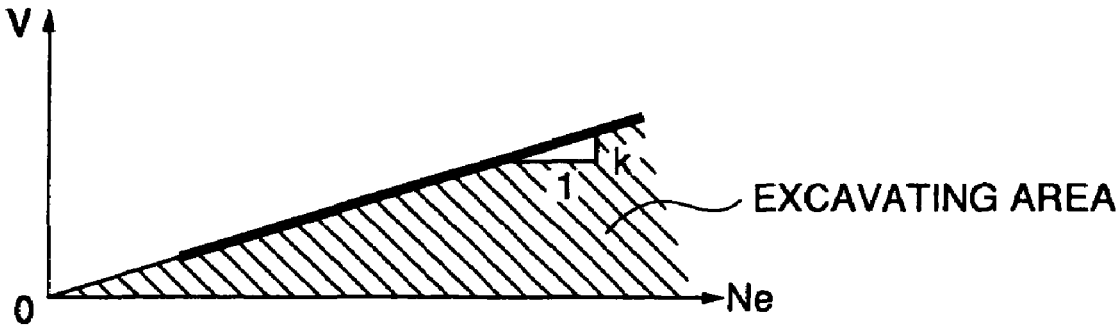
FIG. 4 is a schematic view of an excavating area shown by a vehicle speed and an engine rotational speed.

In the control flow chart, when the automatic tilt setting switch 36 is under the on-operation, the forward and backward moving lever is at the forward moving position, the boom angle θm is equal to or less than the boom angle lower limit value θm1, the kick-down switch 35 is under the on-operation, and the boom lever operating amount Em is larger than the boom lever operating amount lower limit Em1, it is judged whether or not the vehicle speed V enters in the excavating area shown by the hatched portion in FIG. 4 (the steps S1 and S2).

The controller 25 judges whether or not the operator intends to operate the boom lever 30 over the boom lever operating amount upper limit value Em2 so as to quickly ascend the boom 3 (the step S3). The excavating area is set on the basis of the actual vehicle data obtained at a time of the excavation performed by the skilled operator. In the case that the boom lever 30 is operated over the boom lever operating amount upper limit value Em2, the controller 25 judges whether or not the hydraulic circuit of the boom 3 is relieved on the basis of the fact whether or not the boom angular velocity θmd is the zero value (the step S4). When the hydraulic circuit is relieved in spite that the boom lever 30 is largely operated so as to intend to ascend the boom 3, the boom 3 does not ascend, whereby it is impossible to reduce the horizontal resisting force. Then, in order to reduce the horizontal resisting force due to the tilt of the bucket 4, the step goes to a step for starting the automatic excavation control.

When the hydraulic circuit of the boom 3 is not relieved, the boom control command value Vm having the value of the boom lever operating amount Em and the bucket control command value Vt having the value of the bucket lever operating amount Et are output to the electromagnetic proportional command valve 20, and the boom and the bucket are operated in accordance with the lever operating amount performed by the operator. Then, it is judged again whether or not the vehicle speed V is in the excavating area yet.

When the bucket 4 does not ascend in spite that the horizontal resisting force is increased and the boom lever operating amount Em is equal to or more than the boom lever operating amount upper limit Em2, it is judged that the tip end of the bucket 4 is in a state of being eaten into the hard ground, and the automatic excavation control is started. Further, in the case that the vehicle speed V is in the excavating area, the operator does not intend to ascend the boom 3 largely and the boom lever operating amount Em is equal to or less than the boom lever operating amount upper limit value Em2, the automatic excavation control is also started.

When the automatic excavation control is started, when the boom lever operating amount Em is equal to or less than the boom lever operating amount lower limit Em1 (the step S7), it is judged that the operator does not intend to ascend the boom 3, and the boom control command value Vm having the zero value is output to the command valves 21 and 22 so as not to ascend the boom 3 (the step S8).

The bucket control command value Vt is set as the value obtained by adding the bucket flow amount additional value Qt to the bucket lever operating amount Et, and the bucket flow amount additional value Qt is calculated so that the bucket flow amount additional value Qt has a larger % in correspondence to reduction of the engine rotational speed Ne. then, the bucket control command value Vt obtained by adding the calculated bucket flow amount additional value Qt to the bucket lever operating amount Et is set to a command value output to the command valves 23 and 24 operating the bucket 4. In this case, when the calculated bucket control command value Vt becomes a value equal to or more than 100%, the value is set to 100% (the step S9).

As mentioned above, the engine rotational speed Ne becomes small in accordance that the horizontal resisting force and the vertical resisting force become large, however, since it is possible to set the large command value output to the command valves 23 and 24 in accordance that the engine rotational speed Ne becomes small, it is possible to increase the tilt speed of the bucket 4 so as to improve the excavating speed.

On the contrary, when the boom lever operating amount Em is larger than the boom lever operating amount lower limit value Em1, the boom flow amount changing value Qm is output to the command valves 21 and 22 as the boom control command value Vm in place of the boom lever operating amount Em, thereby ascending the boom 3. The boom flow amount changing value Qm is calculated so as to become a larger % in accordance that the engine rotational speed Ne becomes small. In this case, when the calculated boom flow amount changing value Qm becomes a value equal to or more than 100%, the value is set to 100%. Then, the calculated boom flow amount changing value Qm is set to the boom control command value Vm (the step S10).

Next, the bucket flow amount variable αtv changing in accordance with the boom lever operating amount Em is calculated, and the product between the value obtained by dividing the engine high idle rotational speed Nem by the current engine rotational speed Ne, and the bucket flow amount variable αtv is set to the bucket flow amount additional value Qt. Then, the value obtained by adding the bucket flow amount additional value Qt to the bucket lever operating amount Et is set to the bucket control command value Vt (the step S11).

Accordingly, when the boom lever operating amount Em input by the operator is large and the operator intends to quickly ascend the boom 3, it is possible to previously set the bucket control command value Vt additionally tilting the bucket quickly.

Further, since both of the boom control command value Vm and the bucket control command value Vt are set to be larger in accordance that the engine rotational speed Ne becomes smaller, the operation of the boom 3 and the bucket 4 is quickly performed, and the excavating efficiency can be improved.

Further, since it is possible to output the bucket control command value so as to tilt the bucket and properly keep the load applied to the vehicle even when the circuit of the boom control valve is relieved and the boom cylinder is not extended and compressed, the excavating efficiency can be improved.

Next, the mode selecting signal Cc input from the mode selecting button 42 operated by the operator is judged (the step S12). The off signal "0" and the on signal "1" are respectively input to the controller 25 when the excavation resisting force of the loaded object 6 is small and when the loaded object is hard and the excavation resisting force is large.

When the mode selecting signal Cc is the off signal "0", the previously set bucket control command signal Vt is output to the command valves 23 and 24 only for a predetermined time T1 (for example, five seconds) so as to tilt the bucket 4 at a speed corresponding to the bucket control command value Vt and at an angle corresponding to the time T1 (the step S13).

On the contrary, when the mode selecting signal Cc is the on signal "1", the previously set bucket control command value Vt is output to the command valves 23 and 24 two times only at the predetermined ΔT in a pulse manner so as to tilt while vibrating the bucket 4 (the step S14). In this case, the boom control command value Vm and the bucket control command value Vt are called as the automatic excavation command values.

Then, when the stroke end signal Ce is the on signal "1", the automatic excavation control is completed (the step S15).

Accordingly, since it is possible to select the tilting method of the bucket 4 corresponding to the magnitude of the excavating resist of the loaded object 6, the excavating speed can be improved, and it is possible to control in accordance with the intention of the operator. Then, since it is possible to detect the stroke end when the bucket cylinder reaches the stroke end and the automatic excavation is automatically completed, it is possible to perform the automatic excavation control in accordance with the intention of the operator. Further, since it is possible to utilize the bucket cylinder without leaving the stroke of the bucket cylinder, an operation efficiency can be improved.

In this case, in the present embodiment, the start timing of the excavation control is judged in accordance with the steps S1, S2, S3, S4 and S6 in the flow chart, however, it may be started on the basis of the manual command applied from the button or the like operated by the operator. Further, in the present embodiment, it is judged in accordance with the straight line relating to the engine rotational speed as shown in FIG. 4 whether or not the excavation is performed, however, a curve may be employed in place of the straight line without any trouble.

Next, a description will be given of a second embodiment with reference to FIGS. 6, 7 and 8.

Figure 6:
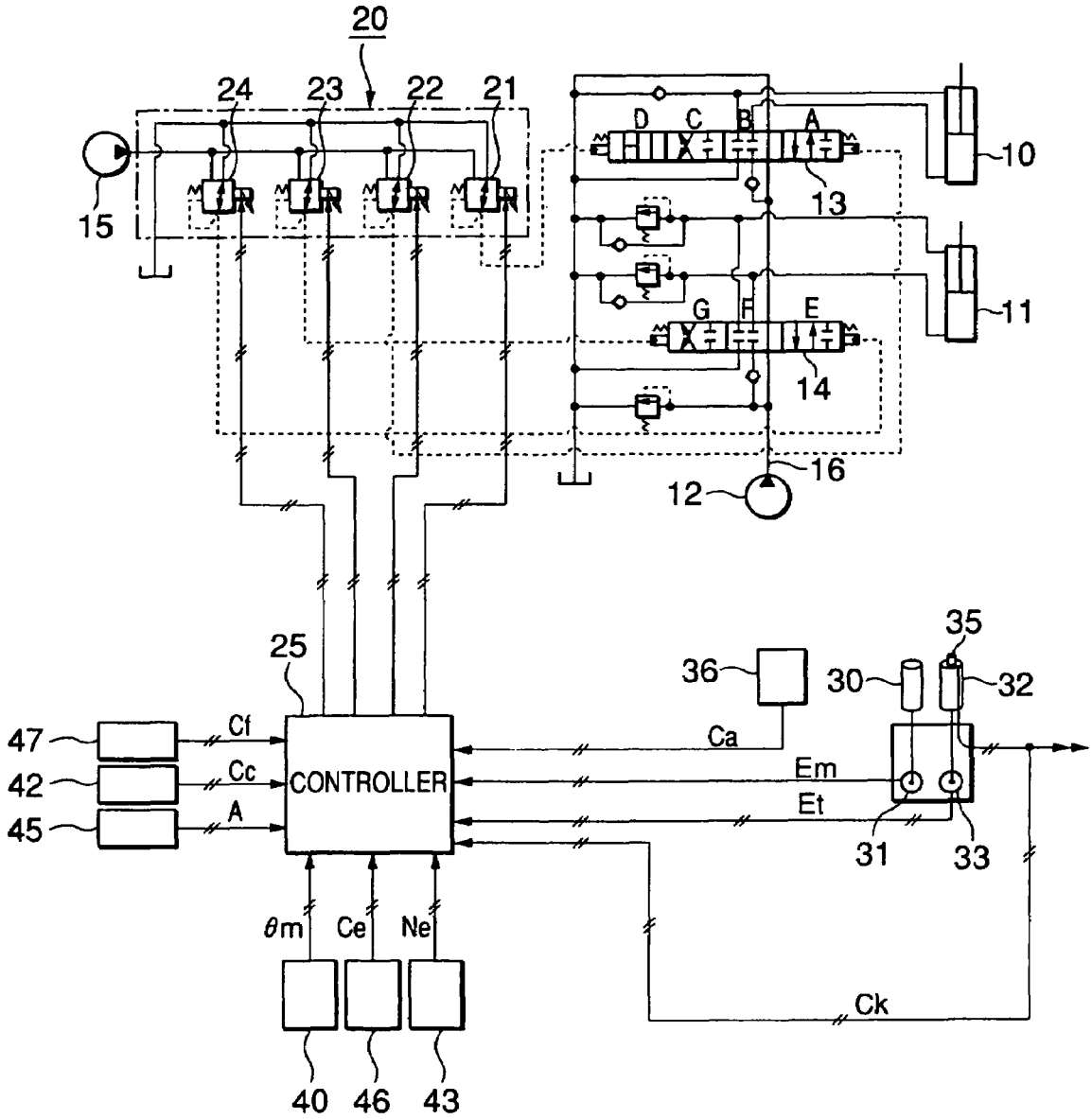
FIG. 6 is a control system diagram of a working unit of a wheel loader in accordance with a second embodiment.

In a control system view shown in FIG. 6, in place of the vehicle speed detector 44 described in the first embodiment, an accelerator pedal operating amount detector 45 for detecting an accelerator pedal operating amount A is provided. The detected accelerator pedal operating amount A is input to the controller 25. Since the other elements than the accelerator pedal operating amount detector 45 are the same as those shown in FIG. 2, a description thereof will be omitted. In this case, the accelerator pedal operating amount detector 45 corresponds to excavating state detecting means detecting an excavating state of the vehicle.

Figure 3:
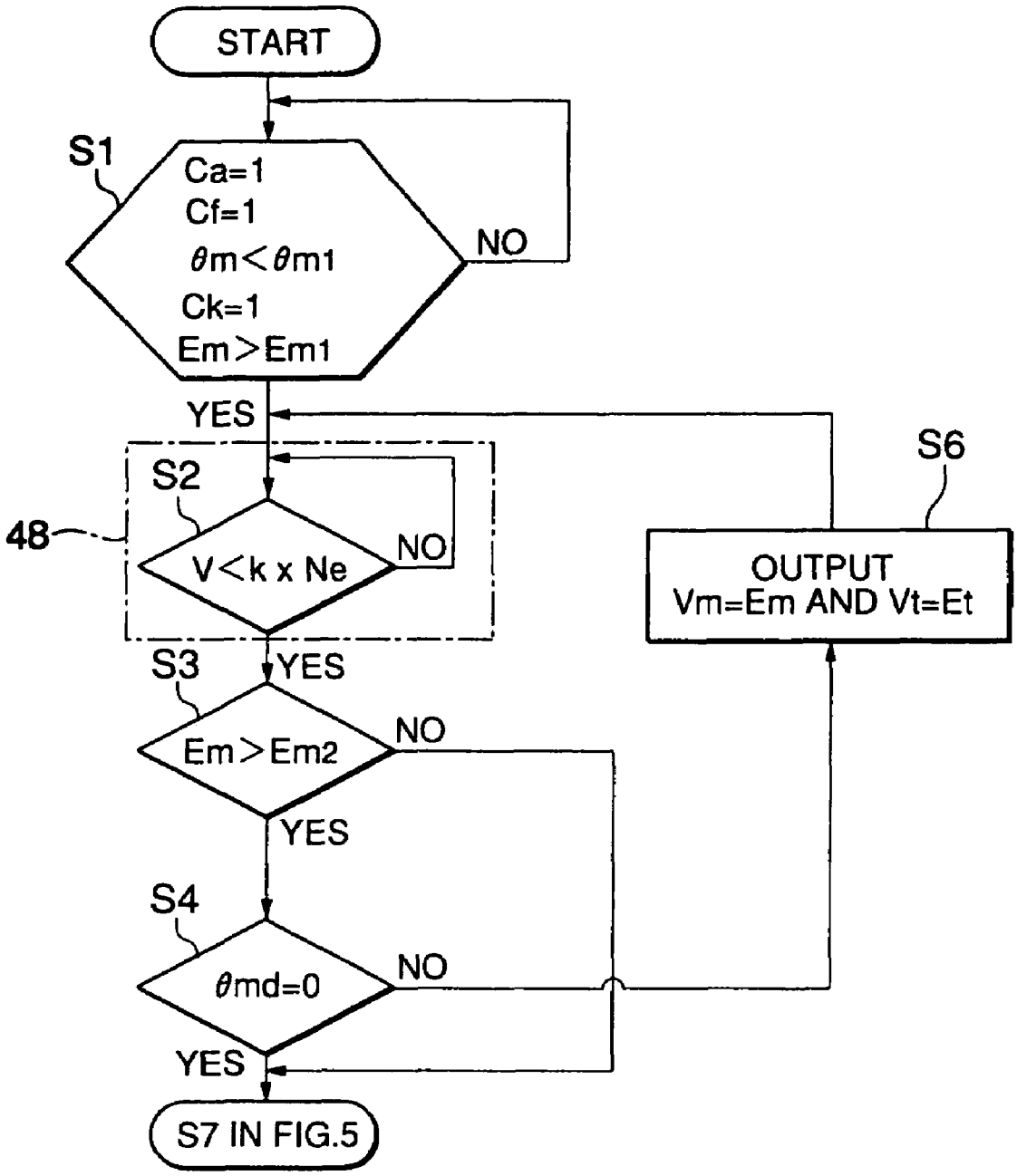
FIG. 3 is a control flow chart of an excavation start judging portion in accordance with the first embodiment.
Figure 7:
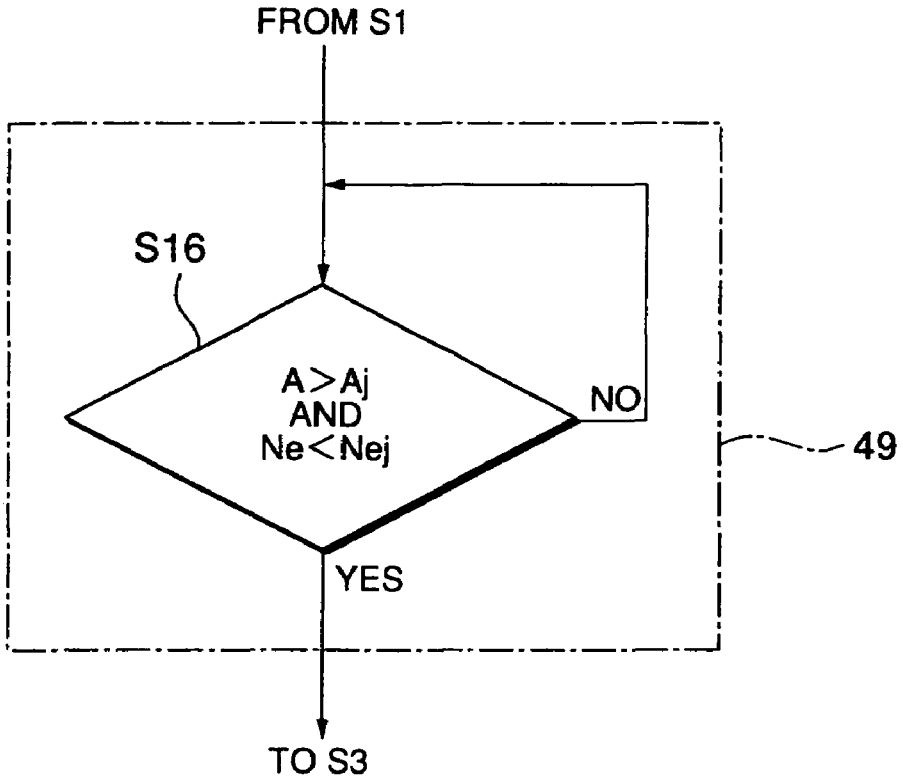
FIG. 7 is a control flow chart of a load second judging portion in accordance with the second embodiment.
Figure 8:
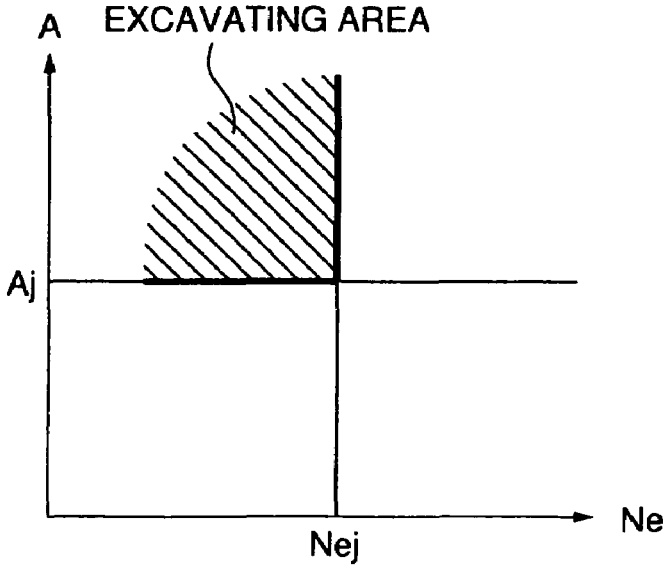
FIG. 8 is a schematic view of an excavating area shown by an accelerator pedal operating amount and an engine rotational speed.

A control flow chart in accordance with the present embodiment corresponds to a flow chart obtained by only changing the load first judging portion 48 in FIG. 3 described in the first embodiment to a load second judging portion 49 in FIG. 7. The other flows in the flow chart are the same as those in FIG. 3. The load second judging portion 49 has a process step S16, and if both of the following two items are satisfied, the step goes to a process in the step S3 in FIG. 3.

(1) An accelerator pedal operating amount A is larger than an accelerator pedal operating amount threshold Aj.

(2) An engine rotational speed Ne is smaller than an engine rotational speed threshold Nej.

If any one item is not satisfied, the process in the step S16 is repeated.

The accelerator pedal operating amount threshold Aj and the engine rotational speed threshold Nej correspond to values set by collecting the accelerator pedal operating amount data and the engine rotational speed data during the excavation performed by the skilled operator, and are previously stored in the controller 25. Further, an excavating area shown by the accelerator pedal operating amount A and the engine rotational speed Ne is shown in FIG. 8. It is judged that the excavation is performed when the engine rotational speed Ne does not become large in spite that the accelerator pedal is pedaled to the accelerator pedal operating amount threshold Aj.

A description will be given of an operation and an effect of the present embodiment.

Since there is employed the operating procedures of the skilled operator that the state in which the accelerator pedal operating amount A and the engine rotational speed Ne is within the excavating area and the boom lever operating amount Em is equal to or more than the boom lever operating amount lower limit value Em1 means the intention expression for the excavation start, it is possible to always start the excavating control at a proper timing.

In this case, since the operation and the effect in the processing method after starting the automatic excavation control are the same as those of the first embodiment, the description will be omitted.

Next, a description will be given of a third embodiment in accordance with FIG. 9.

In accordance with the present embodiment, in the control flow chart in FIG. 3 described with respect to the first embodiment, an operating amount change judging portion 50 performing the process in the step S5 is further provided. The other steps (S1-S4 and S6-S15) and structures are the same as those of the first embodiment.

Figure 9:
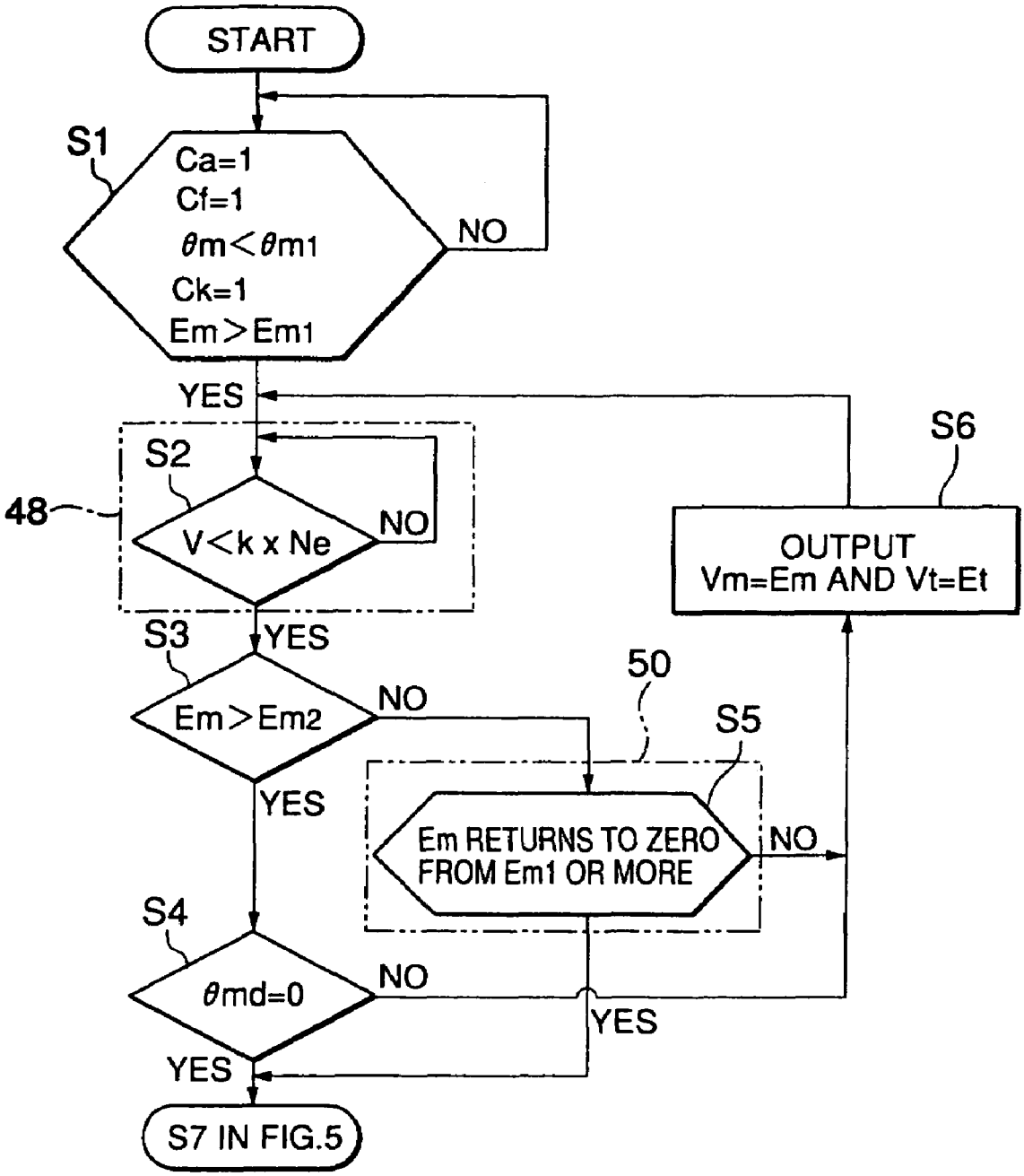
FIG. 9 is a control flow chart of an excavation start judging portion in accordance with a third embodiment.
Figure 10:
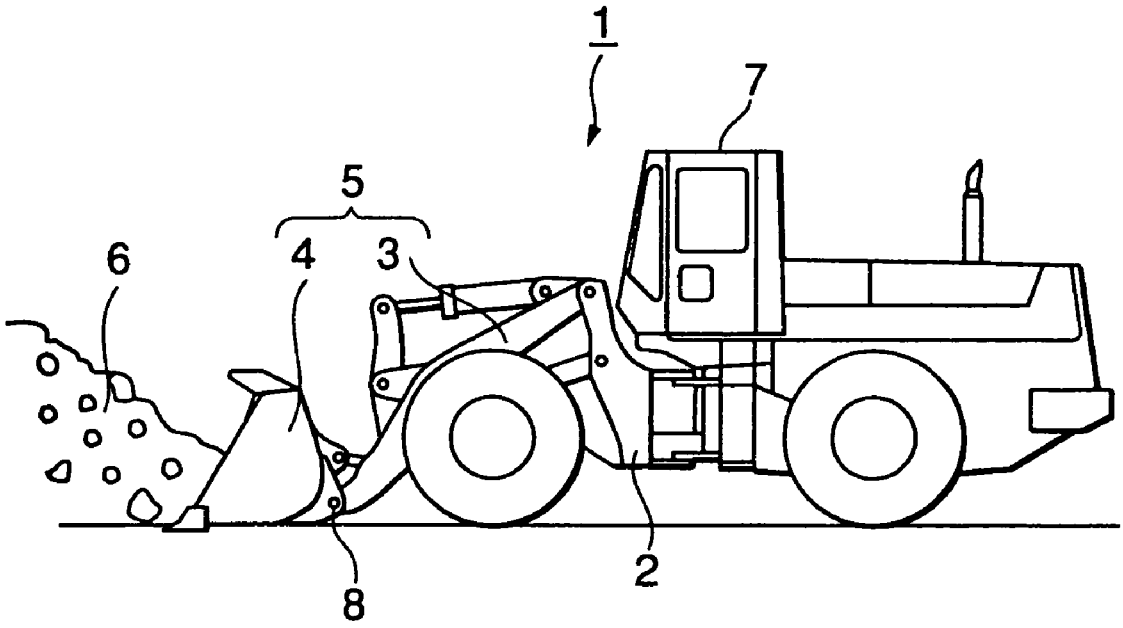
FIG.10 PRIOR ART
FIG. 10 is a wholly side elevational view of a wheel loader.

In the control flow chart in FIG. 9, the following operations are performed.

In the step S3, it is judged whether or not the boom lever operating amount Em is larger than the boom lever operating amount upper limit value Em2. When the boom lever operating amount Em is larger then the boom lever operating amount upper limit value Em2, the step goes to a process in the step S4. On the contrary, when the boom lever operating amount Em is equal to or less than the boom lever operating amount upper limit value Em2, the step goes to a process in the step S5.

In the step S4, it is judged whether or not a boom angular speed θmd is the zero value, and when the boom angular speed is the zero value, the step goes to a process in the step S7, and when it is not the zero value, the step goes to a process in the step S6.

In the step S5, it is judged whether or not the boom lever operating amount Em is returned to the zero value from the value equal to or more than the boom lever operating amount lower limit value Em1. When the boom lever operating amount Em is returned to the zero value, the step goes to a process in the step S7. On the contrary, when the boom lever operating amount Em does not go back to the zero value, the step goes to a process in the step S6.

In the step S6, a boom control command signal Vm having a value of the boom lever operating amount Em and a bucket control command value Vt having a value of the bucket lever operating amount Et are respectively output to the electromagnetic proportional command valve 20, and the step goes back to the process in the step S2.

Figure 5:
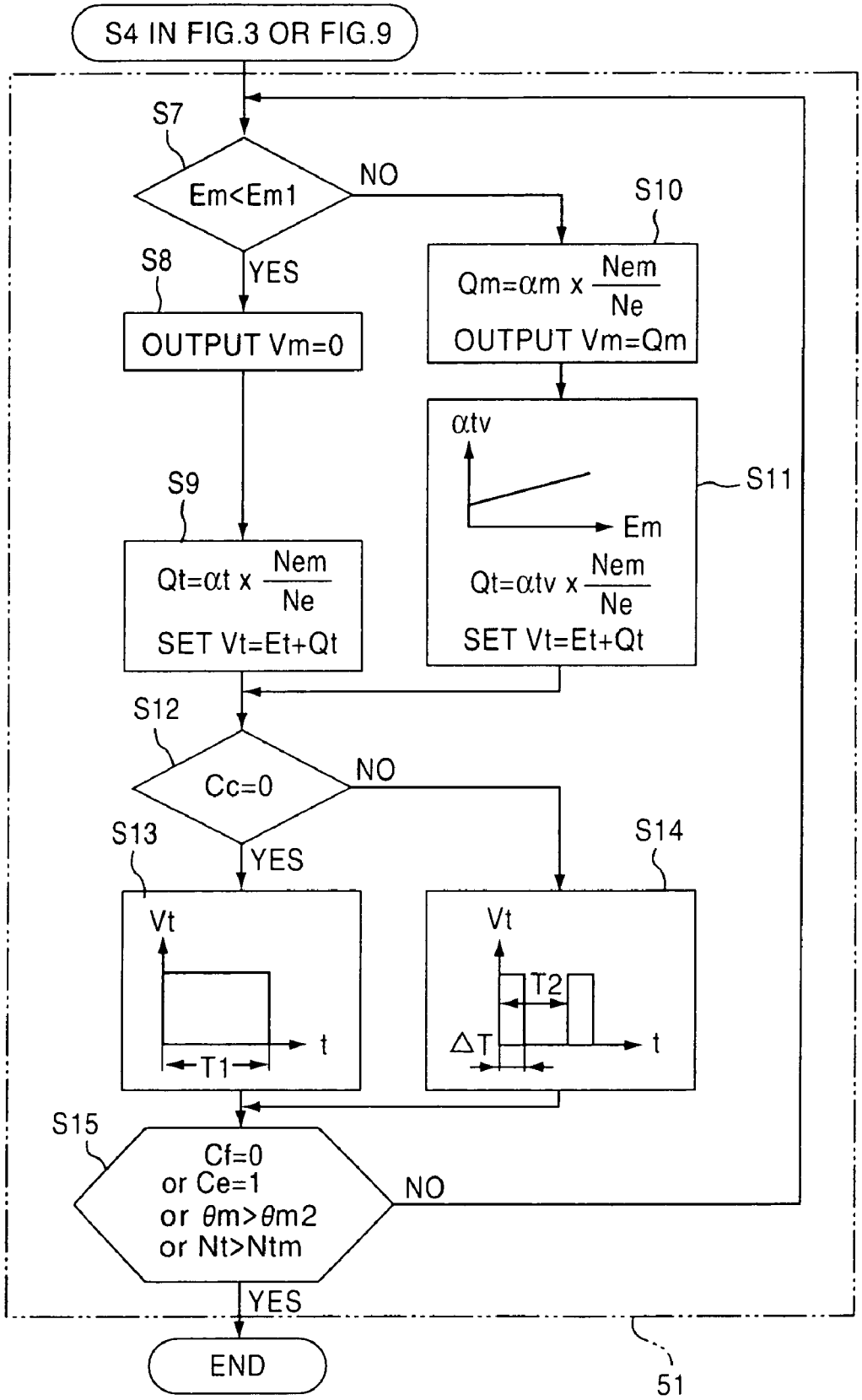
FIG. 5 is a control flow chart of an automatic excavation control portion in accordance with the first embodiment.

Since the processes of the step S7 and after the step S7 are the same as those of the control flow chart in FIG. 5 described with respect to the first embodiment, the description will be omitted.

Next, a description will be given of an operation and an effect of the present embodiment.

The controller 25 judges whether or not the operator intends to operate the boom lever 30 over the boom lever operating amount upper limit value Em2 so as to quickly ascend the boom 3 (the step S3). The excavating area is set on the basis of the actual vehicle data obtained at a time of the excavation performed by the skilled operator. In the case that the boom lever 30 is operated over the boom lever operating amount upper limit value Em2, the controller 25 judges whether or not the hydraulic circuit of the boom 3 is relieved on the basis of the fact whether or not the boom angular velocity θmd is the zero value (the step S4). When the hydraulic circuit is relieved in spite that the boom lever 30 is largely operated so as to intend to ascend the boom 3, the boom 3 does not ascend, whereby it is impossible to reduce the horizontal resisting force. Then, in order to reduce the horizontal resisting force due to the tilt of the bucket 4, the automatic excavation control is started (the step S7).

When the hydraulic circuit of the boom 3 is not relieved, the boom control command value Vm having the value of the boom lever operating amount Em and the bucket control command value Vt having the value of the bucket lever operating amount Et are output to the electromagnetic proportional command valve 20, and the boom and the bucket are operated in accordance with the lever operating amount performed by the operator (the step S6).

On the contrary, in the case that the operator operates the boom lever 30 at an amount equal to or less than the boom lever operating amount upper limit value Em2, the controller 25 judges whether or not the boom lever operating amount Em of the boom lever 30 goes back to the zero value from the value equal to or more than the boom lever operating amount lower limit value Em1 (the step S5). When the boom lever operating amount Em goes back to the zero value, the automatic excavation control is started (the step S7). Further, when the boom lever operating amount Em does not go back to the zero value, it is judged that there is no intention expression for the excavation start, the boom 3 and the bucket 4 are operated in accordance with the lever operation performed by the operator (the step S6).

As mentioned above, in the case that the bucket 4 does not ascend in spite that the boom lever operating amount Em is operated at an amount equal to or more than the boom lever operating amount upper limit Em2 when the horizontal resisting force becomes large, it is judged that the tip end of the bucket 4 is in a state of being eaten into the hard ground, and the automatic excavation control is started. Further, in the case that the vehicle speed V is in the excavating area, the operator does not intend to ascend the boom 3 largely and the boom lever operating amount Em is equal to or less than the boom lever operating amount upper limit value Em2, the automatic excavation control is also started when the boom lever operating amount Em goes back to the zero value from the value equal to or more than the boom lever operating amount lower limit value Em1.

Accordingly, since there is employed the operating procedure of the skilled operator that the intention expression for the excavation start means the time when the vehicle speed V is within the excavating area and the boom lever operating amount Em goes back to the zero value from the value equal to or more than the boom lever operating amount lower limit value Em1, it is possible to start the automatic excavation control at a further proper timing.

In this case, the operations and the effects after the automatic excavation control is started are the same as those of the first embodiment, a description thereof will be omitted.

As mentioned above, in accordance with the present invention, when the load applied to the vehicle from the bucket is equal to or more than the predetermined value and the boom angular velocity is the zero value in spite that the boom lever is operated at a substantially full stroke, the automatic excavation is started. Further, when the boom lever operating amount is reduced after the boom lever is operated at a substantially full stroke, the automatic excavation is also started. That is, since the operation pattern of "operating the boom lever so as to ascend the bucket" performed by the skilled operator at a time of starting the excavation is installed in the control flow, and it is judged that the excavation is started when the operation is performed, it is possible to always securely judge the timing of the excavation start.

Further, when the engine rotational speed becomes small during the automatic excavation control, it is judged that the load applied to the vehicle becomes large, the bucket is quickly increased and the load applied to the vehicle is reduced. On the contrary, when the engine rotational speed is increased, it is judged that the load is small, and the ascending speed of the bucket is restricted so as to prevent the load from being released. Further, since it is intended to quickly ascend the bucket so as to reduce the load, when the operator largely operates the boom lever, the bucket control command value is accordingly set to be large in correspondence to the boom lever operating amount and the tilt speed is made large. Accordingly, since it is possible to always keep the load proper, it is possible to perform the control in accordance with the intention of the operator.

Further, since the structure is made such that the automatic excavation control is completed when the bucket cylinder reaches the stroke end due to the stroke end detector, it is possible to sufficiently make full use of the stroke to the stroke end, so that it is possible to obtain the working unit control apparatus of the excavating and loading machine controlled in accordance with the intention of the operator and having an excellent excavating efficiency. Further, since the bucket angle detector which is conventionally used is not required, a trouble frequency is reduced and a cost can be made inexpensive.

In addition, when the load applied to the vehicle from the bucket is equal to or more than a predetermined value and it is judged that the boom lever is returned to the neutral position after the boom lever is operated so as to ascend the bucket. That is, since the operation pattern of "operating the boom lever so as to ascend the bucket and thereafter returning the boom lever to the neutral position" performed by the skilled operator at a time of starting the excavation is installed in the control flow, and it is judged that the excavation is started when the operation is performed, it is possible to further securely judge the timing of the excavation start.

What is claimed is:

1. A working unit control apparatus of an excavating and loading machine comprising:

a boom cylinder controlling a lift of a boom;

a boom control valve controlling extension and compression of the boom cylinder;

a boom lever instructing an extension and compression speed of the boom cylinder;

a boom lever operating amount detector detecting an operating amount of the boom lever;

a bucket cylinder controlling a tilt of a bucket;

a bucket control valve controlling an extension and compression of the bucket cylinder;

a bucket lever instructing an extension and compression speed of the bucket cylinder;

a bucket lever operating amount detector detecting an operating amount of the bucket lever; and a controller outputting a boom control command value to the boom control valve on the basis of the boom lever operating amount input from the boom lever operating amount detector, and outputting a bucket control command value to the bucket control valve on the basis of the bucket lever operating amount input from the bucket lever operating amount detector, an engine rotational speed detector detecting an engine rotational speed; and a load judging portion to judge whether or not the vehicle is performing excavation, and thereupon to enable automatic operation;

wherein said controller includes an automatic-operation excavation control to set and output an automatic excavation command value to each of the control valves on the basis of (a) manual non-bucket control commands and (b) a non-manual bucket control command value to the bucket control valve, which is based on any one of the engine rotational speed and the boom lever operating amount, the bucket control command value being sent upon a judgement of the load judging portion that the vehicle is performing excavation.

2. A working nit control apparatus of an excavating and loading machine as claimed in claim 1, wherein the automatic excavation control means is structured such as to output a bucket control command value corresponding to the boom lever operating amount to the bucket control valve at a time of operating the boom lever.

3. A working unit control apparatus of an excavating and loading machine as claimed in claim 1, wherein the automatic excavation control means is structured such as to output a bucket control command value which becomes smaller as the engine rotational speed becomes larger to the bucket control valve.

4. A working unit control apparatus of an excavating and loading machine comprising:

a boom cylinder controlling a lift of a boom;

a boom control valve controlling extension and compression of the boom cylinder;

a boom lever instructing an extension and compression speed of the boom cylinder;

a boom lever operating amount detector detecting an operating amount of the boom lever;

a bucket cylinder controlling a tilt of a bucket;

a bucket control valve controlling an extension and compression of the bucket cylinder;

a bucket lever instructing an extension and compression speed of the bucket cylinder;

a bucket lever operating amount detector detecting an operating amount of the bucket lever; and a controller outputting a boom control command value to the boom control valve on the basis of the boom lever operating amount input from the boom lever operating amount detector, and outputting a bucket control command value to the bucket control valve on the basis of the bucket lever operating amount input from the bucket lever operating amount detector, wherein said controller includes an automatic-operation excavation control to set and output an automatic excavation command value to each of the control valves on the basis of (a) manual non-bucket control commands and (b) a non-manual bucket control command value to the bucket control valve, the bucket control command value having no relation to a stop of the boom cylinder and being sent upon a judgement of the load judging portion that the vehicle is performing excavation.

5. The working unit control apparatus of an excavating and loading machine as claimed in claim 4, where bucket control command value includes no relation to an operation of the boom cylinder.

6. A working unit control apparatus of an excavating and loading machine as claimed in claim 1 or 4, further comprising a stroke end detector outputting an on signal as a stroke end signal when the bucket cylinder is at a stroke end so as to input the stroke end signal to the controller, wherein the automatic excavation control means is structured such as to complete the automatic excavation control when the stroke end signal is the on signal.

* * * * *